United States Patent [19]

Thompson

[11] 4,070,879

[45] Jan. 31, 1978

[54] LIGHTWEIGHT-TYPE DETACHABLE LOCK

[76] Inventor: Philip W. Thompson, Apt. B 5729 Cedonia Ave., Baltimore, Md. 21206

[21] Appl. No.: 738,893

[22] Filed: Nov. 4, 1976

[51] Int. Cl.[2] ..... E05B 67/02; E05B 67/08

[52] U.S. Cl. ..... 70/20; 70/41; 70/49; 70/52; 70/39

[58] Field of Search ..... 70/14, 15, 18, 19, 20, 70/21, 30, 49, 52, 39, 41, 42, 35

[56] References Cited

U.S. PATENT DOCUMENTS 3,837,189 9/1974 Atkinson ..... 70/21

*Primary Examiner*—Robert L. Wolfe

*Attorney, Agent, or Firm*—John F. McClellan, Sr.

[57] ABSTRACT

A light-weight type lock having a body assembly and a pair of detachable hasps which protrude from opposite ends of the body. The body is box-like in form with movably related cover and configured body, securable together by keylock operation. The hasp ends are captured between the inner body configuration and the outer body when locked in assembly. In particular embodiments the hasps may be flexible members such as chains, or may be rigid "U" shaped members, either entirely releasible from the body assembly or releasible at one end of the hasp, and the outer and inner body members may slide or may pivot relative to each other to secure and to release the hasps, providing either alternative or simultaneous hasp release.

17 Claims, 7 Drawing Figures

LIGHTWEIGHT-TYPE DETACHABLE LOCK

This invention relates generally to locks and specifically to detachable locks.

In the prior art long-hasp padlocks for bicycles and the like have been publicly sold and used, but have been generally bulky, heavy and unversatile.

Principal objects of the invention are to provide a lock which is particularly versatile, compact, commodious, convenient, strong, durable and attractive in appearance.

Further objects are to provide a lock as described which is simple and convenient to use, economical to make and to buy, and unusually reliable in operation.

In brief summary given for purposes of cursive description only and not as limitation, the invention includes lock body and cover movably related to capture between them and to release from between them hasp structure.

The above and other objects and advantages of the invention will become more readily understood on examination of the following description, including the drawings in which like reference numerals refer to like parts:

FIG. 1*a* is an isometric exploded view of a first embodiment of the invention;

FIG. 1*b* is an isometric assembly-view of the first embodiment in partially disengaged position;

FIG. 1*c* is an isometric assembly-view of the first embodiment in locked position.

GENERAL SHAPE

Figures 1A, 1B, 1C, 2:
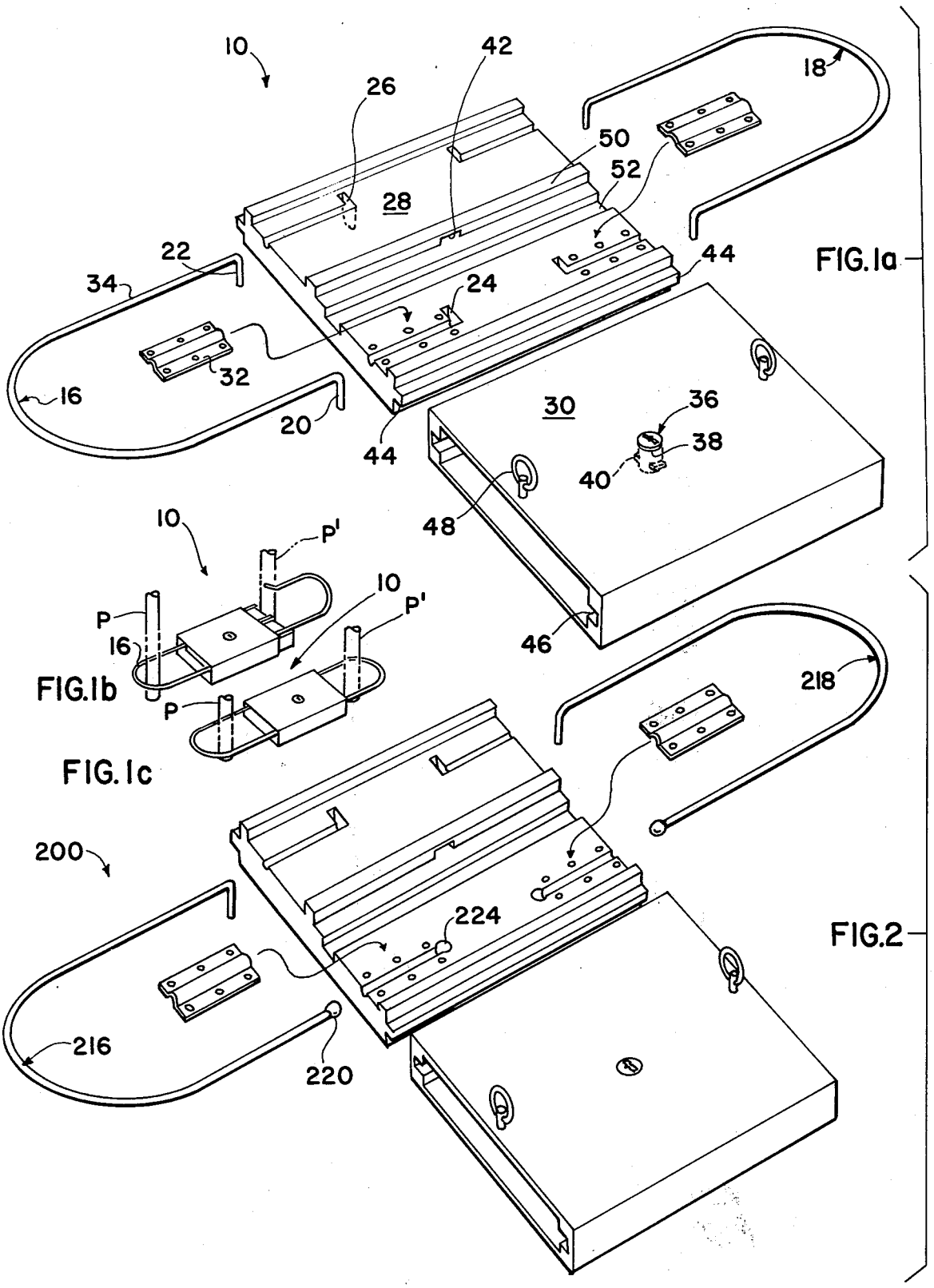
FIG. 2 is an isometric exploded view of a second embodiment.

FIG. 1*a* shows the invention in embodiment 10 comprising first and second arcuate hasps 16, 18, each having cleats 20, 22 at the ends securable in respective apertures 24, 26 in body 28 of the lock by a cover 30 which is slidable over the hasps and the body.

The hasp cleats are downturned at right angles, and the overall structure is somewhat analogous to two horseshoes retained by the cleats between the container and cover of a sliding matchbox, from the ends of which the arcuate portions protrude.

Apertures 24 have inboard ends transversely slotted in the body and the inboard ends of apertures 26 are preferably generally cylindrical in vertical direction in the body.

Anti-tampering lugs as in the third Figure can be employed in all embodiments.

OPERATION

One cleat 20 in each hasp is pivotally secured in the respective aperture 24 by a plate 32 screwed over it.

This permits the hasp to pivot about that aperture when the cover is slid free of that particular hasp, and can be omitted to permit the hasp to be detached from the body if desired.

On pivoting about that aperture the hasp free shank 34 rises clear of the body to a position in which it can be hooked around an object to be engaged, as around a post, or a stanchion of a bicycle rack.

With the object thus engaged, the hasp free shank is then pivoted back to the body and the cover is slid over it, securing the cleat 22 in the aperture 26.

Next, the same procedure is repeated to hook the second hasp 18 around a second object to be engaged, such as a bicycle frame member. The cover this time is slid partially over the first-engaged hasp to clear the second hasp for pivoting.

When both hasps are engaged, the cover is slid to central position on the body and secured in that position by a conventional keylock 36 (which alternatively can be a combination lock). The keylock is staked, welded, or otherwise secured through a hole 38 in the cover with the key access on the outside. When thrown by the key, the keylock bolt 40 slides into a corresponding slot 42 in the body, fixing the cover centrally on the body.

Complementary tongue-and-groove structures 44, 46 along the edges of the body and cover facilitate and secure the engagement of cover to body, and one or more rings 48 may be provided on the cover to facilitate pulling it relative to the body. Longitudinal ridge 50 in the body serves to protect the bolt from tampering, and longitudinal groove 52 provides sliding room for the inner end of the keylock when unlocked. Material for the unit may be hardened steel, although the body may be lightweight cast aluminum, inaccessible as it is to tampering.

It can be seen that the invention provides for use of one or both hasps to be secured to objects, a single hasp being preferably of a size to enclose an object of 1 to 2 inches (2.54 to 5.03 cm) in diameter, and one-tenth of these amounts in cross-section, although no limit is to be implied. It can be seen that hasp-length can be several times hasp-width. Body length and width can be as small as a fraction of an inch if the hasps are proportioned.

FIG. 1*b* shows the position of the parts of the embodiment 10 when the first hasp 16 has engaged a post P and the second hasp is pivoting up, free of the body and cover, to position for engaging a second object P'. The cover is retracted partially over the first hasp to clear the second hasp.

FIG. 1*c* shows the embodiment 10 locked around both objects.

FIG. 2 shows an embodiment 200 with a detail difference from embodiment 10 in that the hasps 216, 218 each have one spherical end 220 replacing a cleat, and a correspondingly shaped aperture 224 in the body to receive the spherical end.

Figure 3:
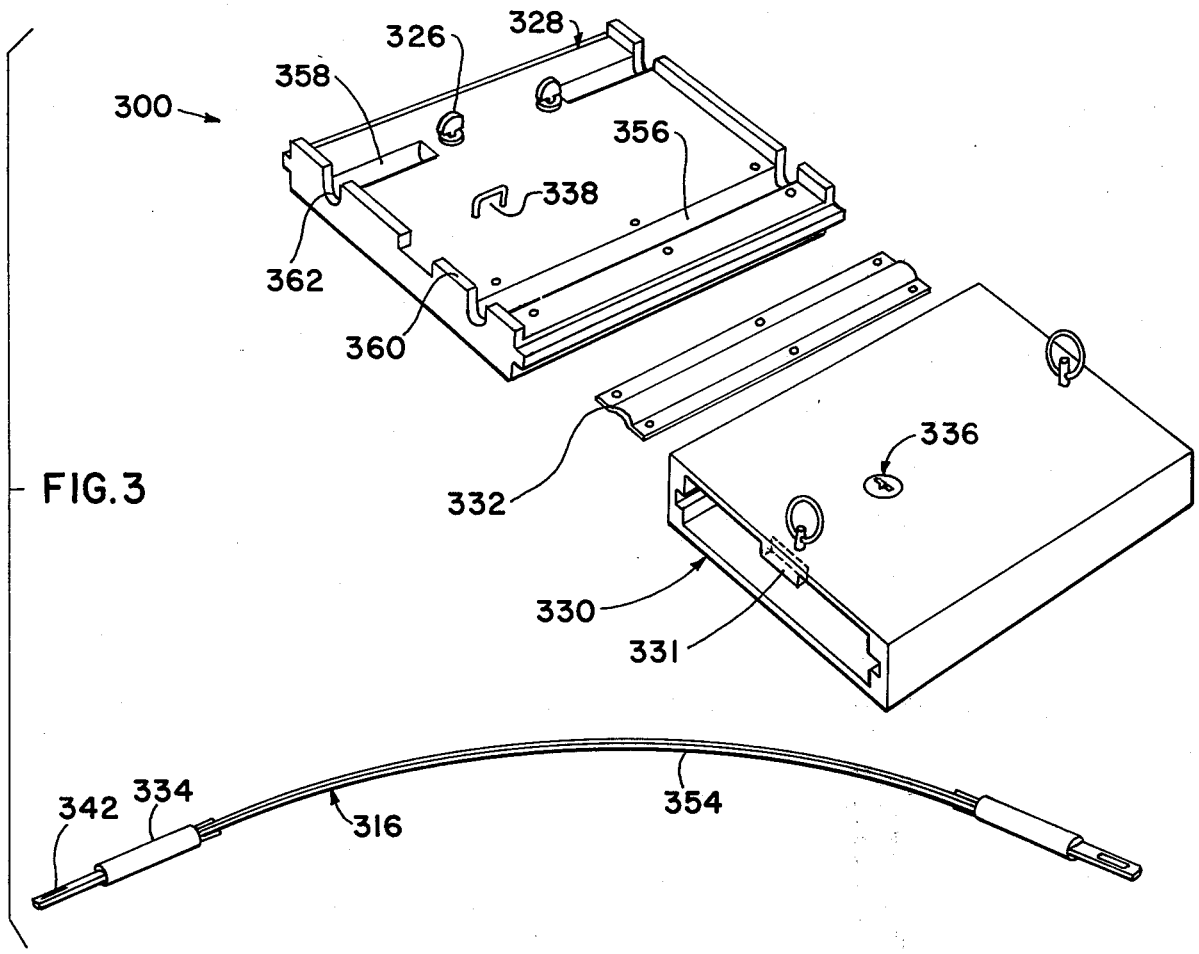
FIG. 3 is an isometric exploded view of a third embodiment.

FIG. 3 shows a further embodiment 300 of the invention generally similar in size and shape to that of the first Figure but with specialized advantages in compactness and flexibility. 331 is an anti-tampering lug.

A flexible wire rope 316 of hardened steel takes the place of the two hasps of the first embodiment. The bight 354 of the rope is clamped in a longitudinal groove 356 in one side of the body 328 by a screw-attached plate 332. Each free end of the wire rope can be looped around to engage a swivel-latch 326 on the body by means of a slot 342 in a metal terminus 334 welded or swaged or otherwise secured to each free end of the wire rope. On entry of a swivel latch through a slot, twisting the latch independently and additionally secures the end of wire rope. A respective groove 358 receives each terminus in the body, and the body may have upstanding end-flanges 360 with grooves 362 to pass each terminus. Keylock securance 336, 338 is provided as before to fix the sliding cover centrally in place on the body. It can be seen in this and the other embodiments that the keylock can be placed at any of various parts of the assembly.

As desired, the wire rope bight may be tightly secured, or it may be loosely secured to pay out more at one end than at the other, providing further versatility of operation when a small hasp will do at one end and a large hasp is required at the other. Flexibility of operation is assured under all circumstances, no special pivoting-space being required for the hasps. In addition the wire rope hasps collapse for most compact carriage in the pocket, and this flexibility makes sawing the wire rope practically impossible unless first gripped in two vices fixed in spacing. Because of the flexibility of the wire rope and the difficulty in cutting it, greater lengths may be employed than with a rigid hasp more subject to bending flexure and eventual parting.

Figure 4:
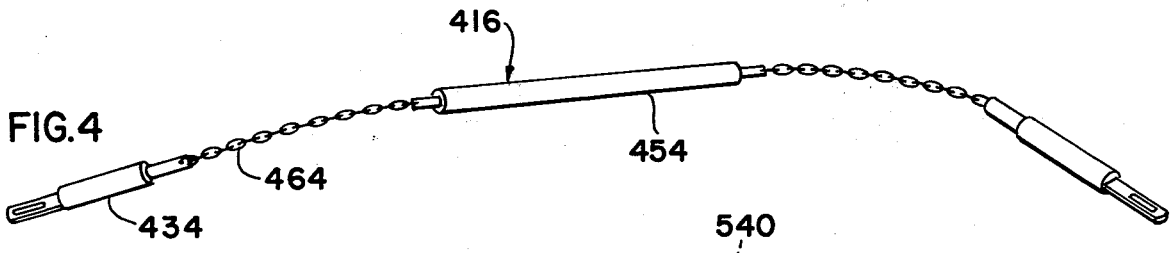
FIG. 4 is an isometric exploded view of a modified detail of the third embodiment.

FIG. 4 illustrates a detail variation on the previous embodiment in the form of a bar-and-chain assembly 416 substitutable for the wire rope hasp assembly. Rigid metal rod or bar 454 when clamped in position in place of the wire rope bight lies in the groove in the body. From each end of the metal bar a length of chain 464 depends and each chain terminates as before in a metal terminus 434 slot-attachable to a respective swivel toggle. After attachment the cover is slid over and locked as before. The bar and chain assembly may be fabricated by means of welding the parts together, and provides a positive stop against enlarging one loop at the expense of the other when tightly clamped. Because of the flexibility, the hardened chain is also difficult to saw.

Figure 5:
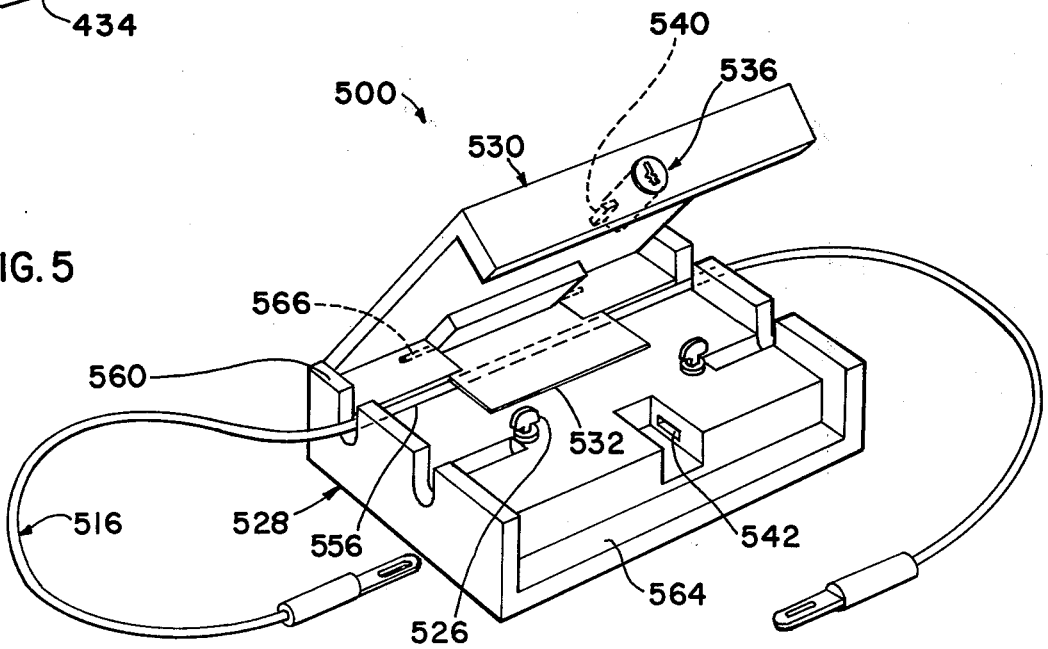
FIG. 5 is an isometric assembly view of a fourth embodiment.

FIG. 5 illustrates an embodiment 500 in which the cover 530 has hinge attachment 566 to the body 528 at one edge. The keylock 536 may be in the top of the cover or in the free edge as shown; in either case it has bolt engagement with a recess 542 in the body when the bolt 540 is thrown by a key. The ends of the body have upstanding grooved anti-tamper flange 564 at the free edge, inside which flanges the cover fits when closed.

Either a wire rope 516 or a bar-and-chain assembly is preferably clamped in groove 556 by a plate 532 as before, and preferably swivel toggles 526 secure the ends as before. Closure and locking of the cover then completes securance at either or both ends to an object or objects.

It can be seen that this embodiment permits simultaneous access to both hasps for attachment or release.

This invention is not to be construed as limited to the particular forms disclosed herein, since these are to be regarded as illustrative rather than restrictive. It is, therefore, to be understood that the invention may be practiced within the scope of the claims otherwise than as specifically described.

What is claimed and desired to be secured by United States Letters Patent is:

1. In a lock having a body, hasp structure having a part protrusive from the body, means including a first recess for securing a first portion of the hasp structure to the body while permitting a second portion thereof to move relative to said first portion, and means at the body for holding said second portion closed in locking position, the improvement comprising: the means for holding including a cover comprising a tubular member with open ends proportioned for sliding over the body to a position over at least said second portion of the hasp structure; and means for locking the cover in said position.

2. In a lock as recited in claim 1, the means at the body for securing including the body having a second recess, said first portion of the hasp structure engaging the second recess, and a member for preventing separation of hasp and body when the cover is not over the hasp first portion.

3. In a lock as recited in claim 2, the first portion of the hasp structure comprising a cleat.

4. In a lock as recited in claim 3, the first portion of the hasp structure comprising a spherical enlargement.

5. In a lock having a body, hasp structure, means for securing a first portion of the hasp structure to the body while permitting a second portion thereof to move relative to said first portion, and means at the body for holding said second portion closed in locking position, the improvement comprising: the means for holding including a cover movable to a position over at least said second portion of the hasp structure, means for locking the cover in said position, the cover comprising a tubular member proportioned for sliding over said body to said position, the hasp structure including a part thereof protrusive from the lock at said first portion and terminating at said second portion and a second said hasp structure, the second hasp structure protrusive from the lock opposite the first said hasp structure.

6. In a lock as recited in claim 5, the second hasp structure being continuous with said first portion.

7. In a lock as recited in claim 5, all said first and second hasp structure comprising an elongate member having first and second ends, with an intermediate portion thereof being said first portion, the respective ends of said elongate member being flexible and serving as respective said second portions of the respective first and second hasp structure.

8. In a lock as recited in claim 7, the means for holding including the respective said second portions of the first and second hasp structure having engagement structure, the body having first and second engaging means for respective attachment to said engagement structure, and said cover in said position covering all said first and second portions.

9. In a lock as recited in claim 8, the engagement structure including at least one slot, and the means for engaging including at least one swivel-latch proportioned for coaction with said at least one slot.

10. In a lock as recited in claim 7, the body having a groove and a plate for affixing said intermediate portion in the groove.

11. In a lock as recited in claim 7, the elongate member intermediate portion being a rigid rod, and said flexible ends including respective chains.

12. In a lock as recited in claim 1, the means for locking including an assembly having a bolt, means for throwing the bolt, means for affixing said assembly to the cover, and the body having means for receiving the bolt when thrown.

13. In a lock as recited in claim 12, the means for receiving including the body having a longitudinal ridge with a recess laterally therein.

14. In a lock as recited in claim 1, the means for holding comprising means pivoting the cover to the body, whereby the cover is pivotally movable to said position.

15. In a lock as recited in claim 14, the body having flange structure for receiving the cover therebetween in said position.

16. In a lock as recited in claim 1, a second said hasp structure, the second hasp structure protrusive from the lock opposite the first said hasp structure.

17. In a lock as recited in claim 1, the hasp structure detachable from the remainder of the lock when the cover is away from said position.

* * * * *